United States Patent [19]

Scott

[11] 4,118,650

[45] Oct. 3, 1978

[54] INTERNALLY SUPPORTED FLAT TUBE DISPLAY

[75] Inventor: Warner Curtis Scott, Dallas County, Tex.

[73] Assignee: Texas Instruments Incorporated, Dallas, Tex.

[21] Appl. No.: 787,393

[22] Filed: Apr. 14, 1977

[51] Int. Cl.[2] ..... H01J 29/46; H01J 29/82

[52] U.S. Cl. ..... 313/422; 315/366

[58] Field of Search ..... 313/422, 105 R, 409, 313/411, 417, 413

[56] References Cited

U.S. PATENT DOCUMENTS

| | | | |
|---|---|---|---|
| 3,935,500 | 1/1976 | Oess et al. | 313/422 X |
| 4,001,619 | 1/1977 | Endriz et al. | 313/105 R |
| 4,028,582 | 6/1977 | Anderson et al. | 313/422 |

*Primary Examiner*—Robert Segal

*Attorney, Agent, or Firm*—James T. Comfort; Rene' E. Grossman; Stephen B. Goldman

[57] ABSTRACT

A flat tube display is fabricated having internal structural supports running the height of the display at selected periodic intervals. This construction permits light weight face plates and back plates to be used in the construction of displays independent of display size, yet still providing the required strength to withstand atmospheric pressure. By compressing the dot matrix of the first plate of the switching stack, relatively large areas free of the dot matrix are provided whereby the internal supports may be attached without interfering with the operation of the display. The control plates of the flat tube display are psuedo-aligned to the phosphor screen. Electrons are injected into the stack channel comprising plates at successively higher positive potentials so that self-guiding through the channels at 100% transmission is achieved.

7 Claims, 6 Drawing Figures

INTERNALLY SUPPORTED FLAT TUBE DISPLAY

BACKGROUND OF THE INVENTION

The present invention relates in general to an electron beam scanning device, and more particularly to a flat tube display having internal structural supports.

Cathode ray tubes (CRT) used for display purposes in general are large volume devices housing structure for forming and deflecting and using an electron beam. Conventional television systems are bulky primarily because depth is necessary for an electron gun plus the associated deflection system.

Information systems generally, including television and alphanumerics, depend upon effective display of information which a viewer is to perceive. CRT devices are among the many types of systems used to present such data. CRT systems are more versatile than many other display devices in that they permit presentation not only of alphanumeric data, but also of full range analog data in black and white as well as in color.

There exists the need for a flat tube display, i.e., a tube in which the ratio of display area to enclosed volume is greatly minimized relative to existing devices. The idea would be a thin plate or panel on which there would appear such information as is designated by input digital or analog input signals.

Flat tube displays become increasingly difficult to build as they become larger because of the strength required in the face plate and the envelope to withstand atmospheric pressure. This problem is especially severe in a video display where the display is continuous and there is no room between display elements to attach the support structure. If internal supports could be incorporated in the flat tube display without interferring with the display itself, displays of any arbitrary size could be made using light weight face plates and envelopes.

One method of flat tube display construction having internal support is taught in U.S. Pat. No. 3,935,499, issued Jan. 27, 1976, assigned to Texas Instruments Incorporated, the same assignee of the present application. In the embodiment a plurality of ribs serve to support the face plate against atmospheric pressure so that evacuation of the interior of the envelope formed by the base and the face plate will not result in breakage of the relatively thin face plate. However, it is to be noted that a full screen presentation will not be possible because of the contact areas between the support structure and the face plate. For small diameter tubes only a mesh structure may be interdeposed between the face plate and the top of the support structure in order to prevent the dead areas on the screen.

In supporting the flat tube display by the internal ribs between the output buffer and the phosphor screen sufficient area must be provided between the apertures for atachment of the ribs. This construction imposes a limitation on the resolution achievable in the flat tube display when using the internal rib supports at the output buffer stage.

Accordingly, an object of the present invention is to provide an internally supported flat tube display where the support structure does not limit the resolution of the display.

Another object of the present invention is to provide for the fabrication of flat tube displays using light weight face plates and back plates independent of the display size.

Yet still another object of the present invention is to provide an internally supported flat tube display where the support structure does not reduce full screen presentation.

SUMMARY OF THE INVENTION

Flat tube displays become increasingly difficult to build as they become larger because of the strength required in the face plate and envelope to withstand atmospheric pressure. Internal rib supports are incorporated in the tube without interferring with the display, so that displays of any artibrary size and resolution can be made using light weight face plates and envelopes.

The only place the multiple electron beams of the flat tube display must be at their desired display position is at the phosphor screen. They do not have to be there as they enter the input buffer, that is, the dot matrix of the desired display on the phosphor screen does not have to have a one to one corespondence with the dot matrix at the input buffer of the switching stack. In this manner, the input buffer plate to the switching stack may be fabricated where the apertures are compressed so as to provide flat portions where the internal rib supports may be attached to support the control plates. Each successive control plate will have the apertures slightly spread apart until the final output buffer plate is reached at the phosphor screen where the apertures will be in a one to one correspondence with the dot matrix of the phosphor screen.

Electrons are injected into the control stack channel composed of plates at successively higher positive potentials. These successively higher potentials will cause the electrons to self-guide through the channels at 100% transmission even though the channels are not perfectly aligned in that they are pseudo-aligned. Using this technique, a plurality of plates allows for the lateral movement of an electron beam as it passes through the control plates of the switching stack of the display.

BRIEF DESCRIPTION OF THE DRAWINGS

The invention, taken together with its various features and advantages, can easily be understood from the following more detailed description taken in conjunction with the accompanying drawings in which.

DETAILED DESCRIPTION

Figure 1:
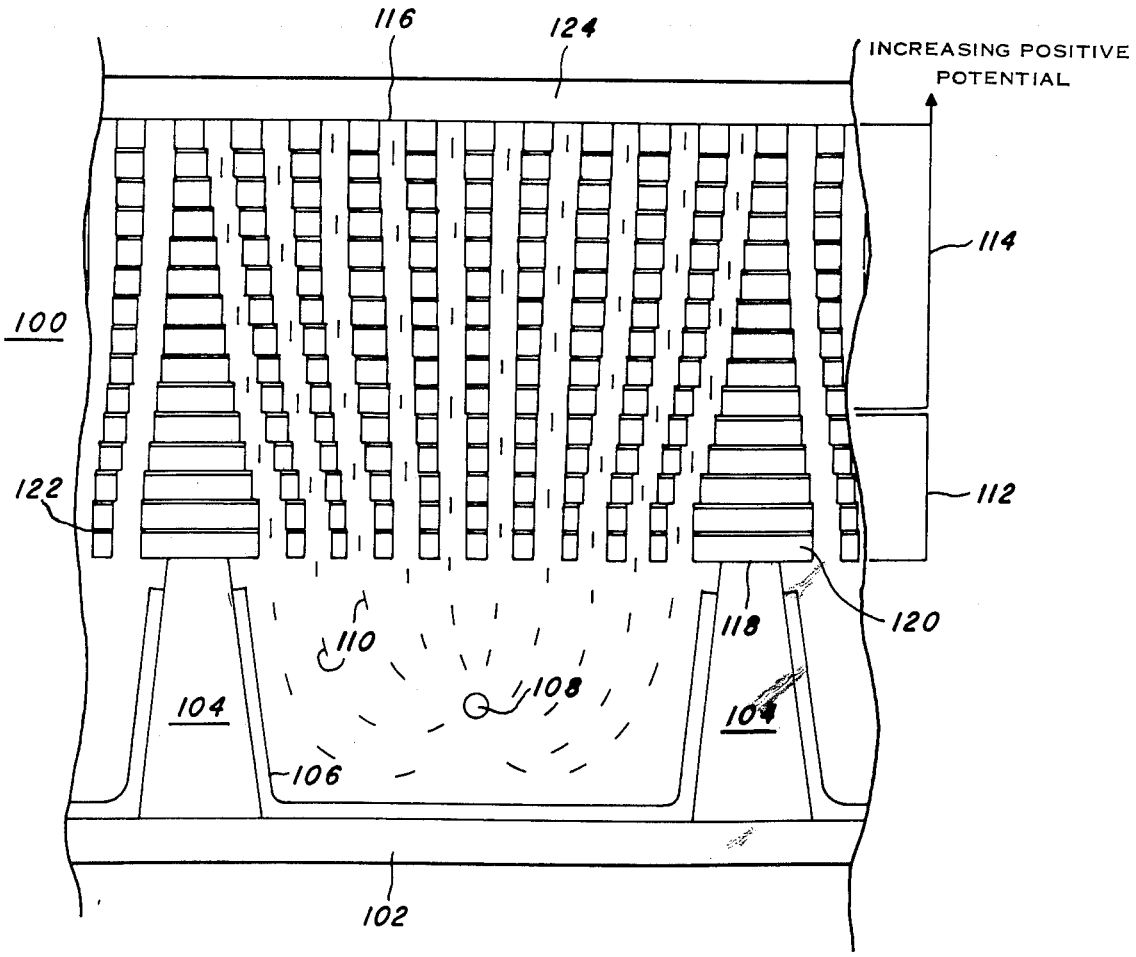
FIG. 1 is a cross-sectional view of one section of a flat tube display disclosing the internal rib supports and the pseudo-aligned control plates.

Referring now to FIG. 1, section 100 of a flat tube display having internal support ribs 104 is shown. In operation of the flat tube display the only place multiple electron beams 110 of the display must be at their desired display position is at phosphor screen 116. It is not required that the dot matrix of the input buffer have a one to one correspondence with the dot matrix of the phosphor screen. To operate the display in this manner, the electron beams as they enter input buffer 120 must be moved to the correct position to correspond to the phosphor dots. Electrons can be ejected into a control stack channel composed of plates at successively higher positive potentials, whereby they will be self-guided through the channels with 100% transmission even though the channels are not in perfect alignment, i.e., psuedo-aligned. This type of pseudo-alignment is illustrated in FIG. 1.

Each upward step in the plate potential produces a positive electro-static line which serves to continuously keep the electrons focused in the center of the channel. Such a series of plates allows for the lateral translation of the electron beam as it passes through the plates of the control stack. The flat tube display stack may be fabricated by a number of techniques.

One approach to the construction of a flat tube display is described in U.S. Pat. No. 3,979,635, filed Sept. 7, 1976, assigned to Texas Instruments Incorporated, the same assignees of the present application. A plurality of control plates are sandwiched between a cathode and a target to control the flow of charge particle such as electrons and ions between the cathode and the target. Each control plate has a plurality of apertures which are effectively aligned with corresponding apertures on the other control plates. At least one input buffer plate and one output buffer plate are sandwiched between the control plates and the cathode and target respectively. The input buffer plate and the output buffer plate have a plurality of apertures aligned with corresponding apertures in the control plate. The aligned apertures from electron beam channels. The control plates have conductive electrodes thereon arranged in predetermined coded patterns. DC voltages are applied to the buffer plates to provide electron optic lensing and voltages are selectively applied to the control plate electrode by switching circuitry to selectively open and close the beam channels. The separation of the buffer plates from the control plates is by spacer plates to isolate the control plates from the high voltages associated with the buffer plates. By selective switching control of the control plates a beam, or a plurality of beams, can be directed to a selected portion or portions of the target at a time.

One technique employed for the fabrication of flat tube displays is from glass switching plates and glass spacer plates. Each plate is provided with the matrix of apertures fabricated by a chemical etching technique. In fabricating a matrix of apertures in glass plates, etching masks are employed to protect selected planar surfaces of the glass plates from the etching solution. The switching plates are coated on both sides and through the aperture holes with a metalized thin film employing standard techniques. This metalized thin film is patterned into an appropriate switching matrix using either a conventional photolithographic metal etching technique or standard photoresist lift off techniques.

The switching stacks thereby comprise alternate layers of glass switching plates and glass insulating plates. The matrix array of aligned apertures in the glass plates provide electron beam channels to the phosphor coated screen. Gold leads are bonded to a mounting plate during the assembly providing for the external electronic circuit connections.

Another method for the fabrication of the flat tube displays is disclosed in copending application Ser. No. 746,909, filed Dec. 2, 1976, assigned to Texas Instruments Incorporated, the same assignee of the present patent application. Described is a method for making a metal-dielectric electron beam scanning stack. The electron beam scanning stack assembly is fabricated from metal plates having a plurality of apertures. Individual apertures are aligned with corresponding apertures of the other plates to form a plurality of transverse electron beam channels. These plates are electrically isolated from and bonded to each by layer of dielectric material with or without the use of a spacer plate. By etching isolation channels in each of these plates in a selected pattern, control plates are fabricated having a plurality of isolated conductor portions arranged in preselected patterns. Subassemblies are bonded together using dielectric material or dielectrically coated metal spacer plates having a plurality of correspondingly aligned apertures. Contact leads from the isolated conductor portions are isolation etched into the inactive pheripheral area of the plate. These leads extend along the pheriphery of the plate where they terminate in the form multiple contact tabs protruding from the edge of the plate.

Using either of these techniques or an equivalent technique the flat tube display stack as shown in FIG. 1 may be fabricated. The control stack of the display is divided into an upper portion 114 and a lower portion 112. Upper portion 114 comprises a plurality of buffer plates, each plate being at a successively higher positive potential. This increasing positive potential provides for the 100% transmission of the electron beam through the pseudo-aligned apertures.

The lower portion of control stack 112 contains the switching plates for control of the electron beams. The plates comprise an input buffer plate, one or more row and column switching plates, one or more modulating plates, and an output buffer plate. The particular arrangement of the switching plates and the number of the switching plates in the display may be altered without departing from the scope of the present invention.

The exterior of the flat tube display comprises a metal envelope having a back plate 102 and an oppositely positioned target member 124. Between the phosphor screen 116 and the back plate 102 is located plurality of control plates 114 and 112. The target member of face plate is mounted on top of the last control plate of the stack and is thereby supported by it. The entire stack itself is supported by internal rib structures 104 which run the entire vertical height of the display and are attached or supporting to back plate 102. A cup cathode 106 is provided along back plate 102 along the sides of rib structures 104 so as to deflect electron beams 110 that are being emitted from filament wire 108 into the channels of the control plates.

The alignment of the aperture matrix of the last plate in acceleration stack 114 corresponds to a one to one relationship with the dot matrix on the phosphor screen 116. The same number of apertures is contained in the first input buffer plate of switching stack 112. However, the apertures are compressed sufficiently so as to provide a significantly large flat portion 118 between sets of apertures. This flat portion provides means for attaching or supporting rib structure 104 to the control stack without interferring with the operation of the electron beams or the control stack itself. The aperture matrix of each successive plate going to the phosphor screen is expanded until the one to one correspondence is obtained in the last plate of the acceleration stack.

In operation filament wire 108 admits electron beams 110. These electron beams are deflected into the channels of the control plates by means of cup cathode 106. In this manner the electrons enter switching stack 112 wherein circuitry is provided for applying a turn on potential to selected aligned apertures of corresponding plates to allow for the passage of the electron beams therethrough and circuitry is provided for applying a cutoff potential to the other apertures to prevent the other electron beams from reaching the phosphor screen. Upon reaching acceleration stack 114 where increasing positive potentials are applied to each of the control plates, the electrons are then transmitted to the phosphor screen with 100% transmission.

The phosphor screen operates at a potential of about 15,000 to 20,000 volts. Switching stack 112 will operate in the range of about 25 volts. Acceleration stack 114 will therefore increase in positive potential from 25 volts to about 20,000 volts. Each plate in the stack is separated from a neighboring plate by a layer of frit glass or ceramic 122. The number of acceleration plates and the magnitude of step increases in positive potential between the plates depends upon the dielectric breakdown strength of layer 122. In a frit glass layer of about 2 mils, a positive potential increase of about 2,000 volts may be used. Therefore, about 10 accelerating plates would be necessary to reach the phosphor screen having a potential of about 20,000 volts. However, the magnitude of positive potential step changes between plates is arbitrary and may be of a different value other than 2,000 volts. In this case the number of plates will be increased or decreased depending upon the dielectric breakdown strength of the material used to bond the plates together.

In the fabrication of the flat tube display the rib supports 104 are periodically spaced along the vertical axis of the display. The spacings may be in the range of from ¼ to 1 inch or as desired. By using the internal rib structures the target member 124 may be reduced significantly in thickness to a range of approximately 5/32 to ¼ of an inch and an approximate 40 mil. metal envelope may be used for a large diameter display. In fact, thinner metal plates and target members may also be used and still maintain the required mechanical strength under vacuum. Using this technique of the rib structures allows for fabrication of any size flat tube display independent of the glass plate thickness and the metal envelope thickness. This significantly reduces the weight of the display as a function of its size.

The rib structures 104 may be constructed from metal or dielectric material. In the case of metal construction they would be insulated from the control stack by dielectric material. In addition, if they are of metal construction they may comprise the cup cathode portion itself rather than in a dielectric support where a separate cup is employed.

The physical shape of the ribs may be in a variety of forms. In this embodiment indicated they are of triangular construction. However, other shapes may be used, for example, rectangles, I-beam, etc.. In addition the ribs may be in segments rather than one continuous support. The rib structure provides additional benefits in that it eliminates the complication of a given hole receiving an emission from more than one filament wire. In this respect the wash boarding problem is eliminated. This allows for the use of fewer yet larger diameter filament wires which are inherently stronger and more durable and more desirable for larger flat tube displays.

Figure 2:
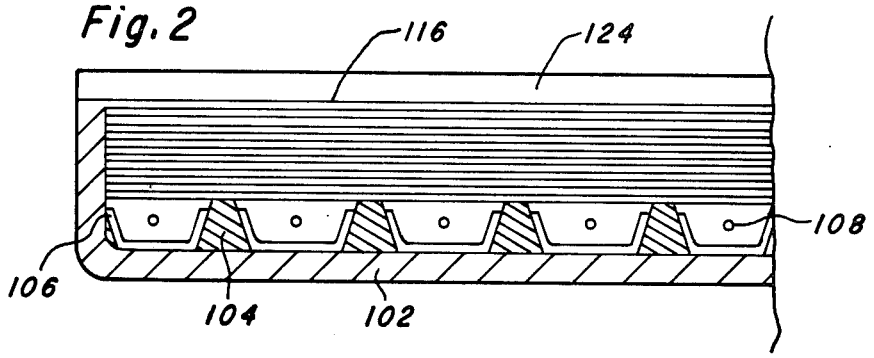
FIG. 2 is a cross-sectional view of a section of a completed flat tube display showing the periodic rib structures contained therein.

Referring now to FIG. 2 the top cross section of a flat tube display having the internal rib supports is shown. As can be seen a plurality of these rib supports 104 run vertically throughout display. They are mounted between the back plate 102 of the envelope and support the plurality of the control plates. The control plates themselves provide support for the target plate 124. In addition, a cup cathode 106 is provided between the structure that support the control plates and a filament wire 108 is provided for each individual cup cathode. The number of rib structures is only dictated by the period of their spacing and the size of the display.

Figure 3:
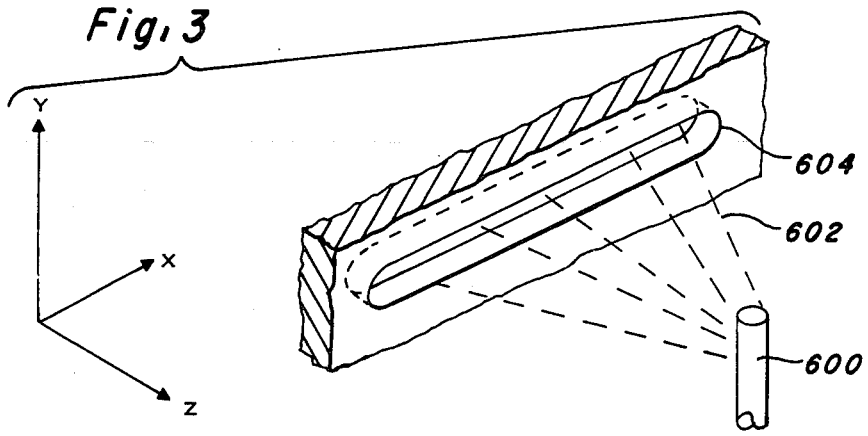
FIG. 3 is a prospective showing the effect of the slot aperture construction as to the acceptance angle for electrons from a filament wire.

For a variety of operating reasons it is preferable to orient the filament wires in the area cathode vertical for video displays, that is perpendicular to the individual video raster lines. Referring now to FIG. 3 we can define a coordinate system where Y is the vertical axis of the picture, X is the horizontal axis of the picture, and Z is the perpendicular axis to the phosphor screen. Thus by the nature of the operation of the flat tube display an area cathode with filament wires parallel to the Y axis provides electrons to the switching stack with almost negligible Y velocity and finite, non-negligible X velocity. The most important factor in stack transmission is the parallelism of the incident electrons compared with the aspect ratio of the hole in the stack. That is, the greater the diameter of the hole in the switching stack, the greater will be the percentage transmission of electrons that go into the hole to begin with. The fact is, however, that this transverse hole dimension need only be as large as possible along the direction in which the incident electrons have finite transverse velocity. This says that in the coordinate system we have defined the stack holes only need to be as large as possible in the X dimension but need not be in the Y dimension. In fact, the small vertical Y dimension of the hole is a benefit in that the low aspect ratio in this dimension makes the hole easier to turn off. Filament wire 600 is emitting a plurality of electron beams 602. These electrons as they spread out from filament 600 will be accepted by slot aperture 604. The slots may be of a variety of sizes. For example, the slot may be large enough to encompass only the passage of one electron beam. On the other hand, the slot may be large enough to provide for the passage of a plurality of electron beams. The concept of using slots in a flat tube display may be used in a supported structure as well as a non-supported structure. In addition, such slots may be incorporated with other control plates having other aperture shapes, such as circles.

Figure 4:
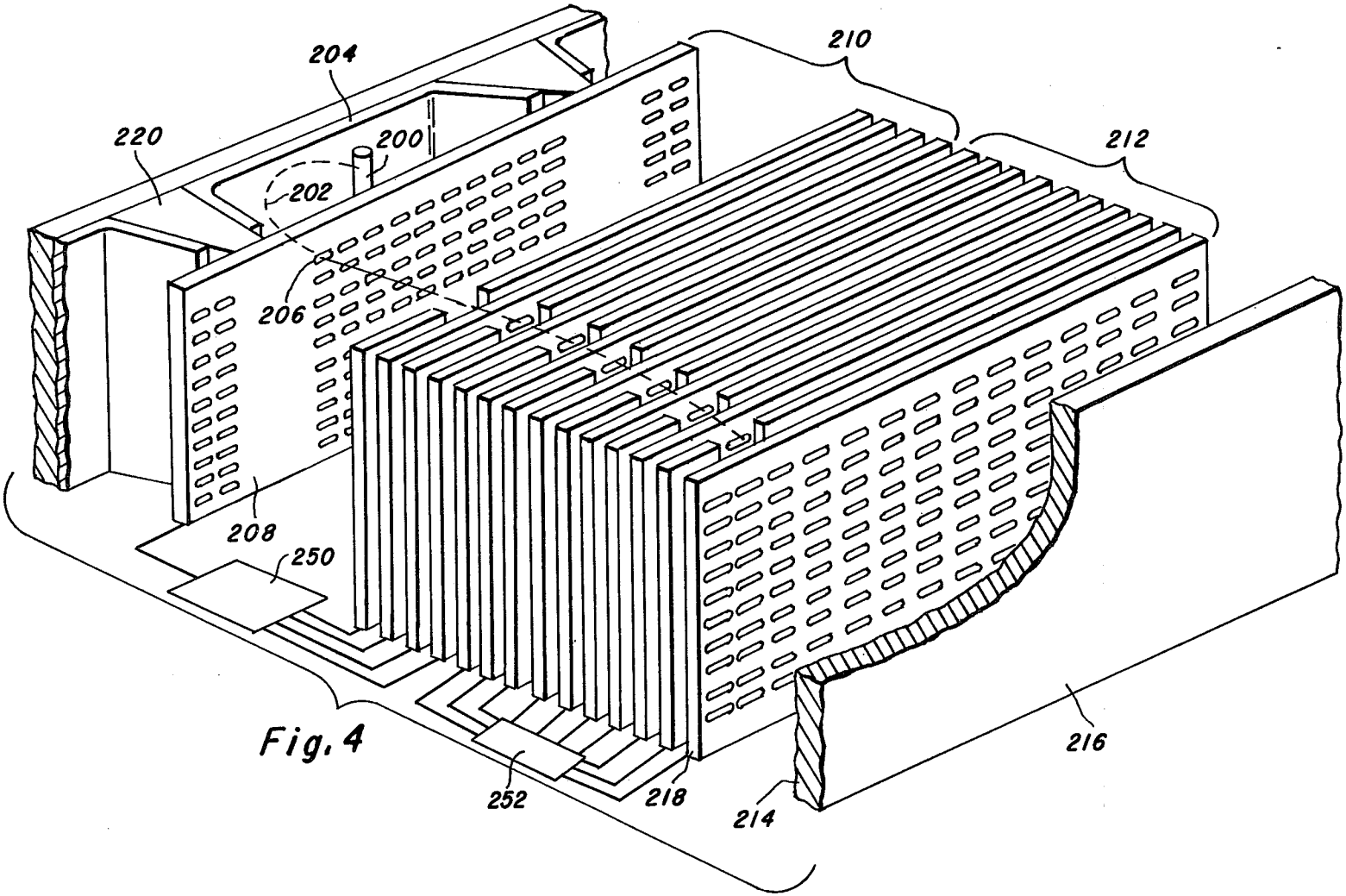
FIG. 4 and FIG. 5 are perspective views of a flat tube display disclosing the use of slots for apertures in conjunction with the internal rib support structure.

Referring now to FIG. 4, a support flat tube display using slots is indicated. A filament wire 200 in the vertical position is used to provide a plurality of electron beams 202. These beams are deflected by the cup cathode 204. These electron beams are projected through individual horizontal slot apertures 206 in the first control plate 208. Electron beams pass through the switching stack 210 into the accelerating stack 212 and reach the phosphor screen 214 of the target plate 216. The operation of the supported stack is as previously described where increasing positive potentials applied to the accelerating stack 212 allow for the non one to one correspondence of the dot matrix between the phosphorus screen 214 and that of the first control plate 208.

Circuitry 250 is provided for applying a turn-on potential to selected aligned apertures of corresponding plates in the switching stack 210 to allow the passage of electron beams therethrough. In addition, circuitry 250 provides a cut-off potential to the other apertures to prevent the electron beams from reaching the phosphorus screen. Circuitry 252 is provided to apply increasing positive potentials to each plate of the acceleration stack 212 to allow the electrons to be guided through the apertures of the control stack at increasing acceleration to the phosphorus coated screen.

The slots in the first control plate are compressed into a matrix so as to provide sufficient area for the support ribs 220 without interfering with the apertures 206. The aperture matrix is gradually expanded in each successive control plate until the last plate 218 of the control stack has apertures that have a one to one correspondence with the phosphor target 214. A cut out view through the control stack shows an electron beam being accelerated through the stack of pseudo-aligned plates at 100% transmission to the phosphor target.

Figure 5:
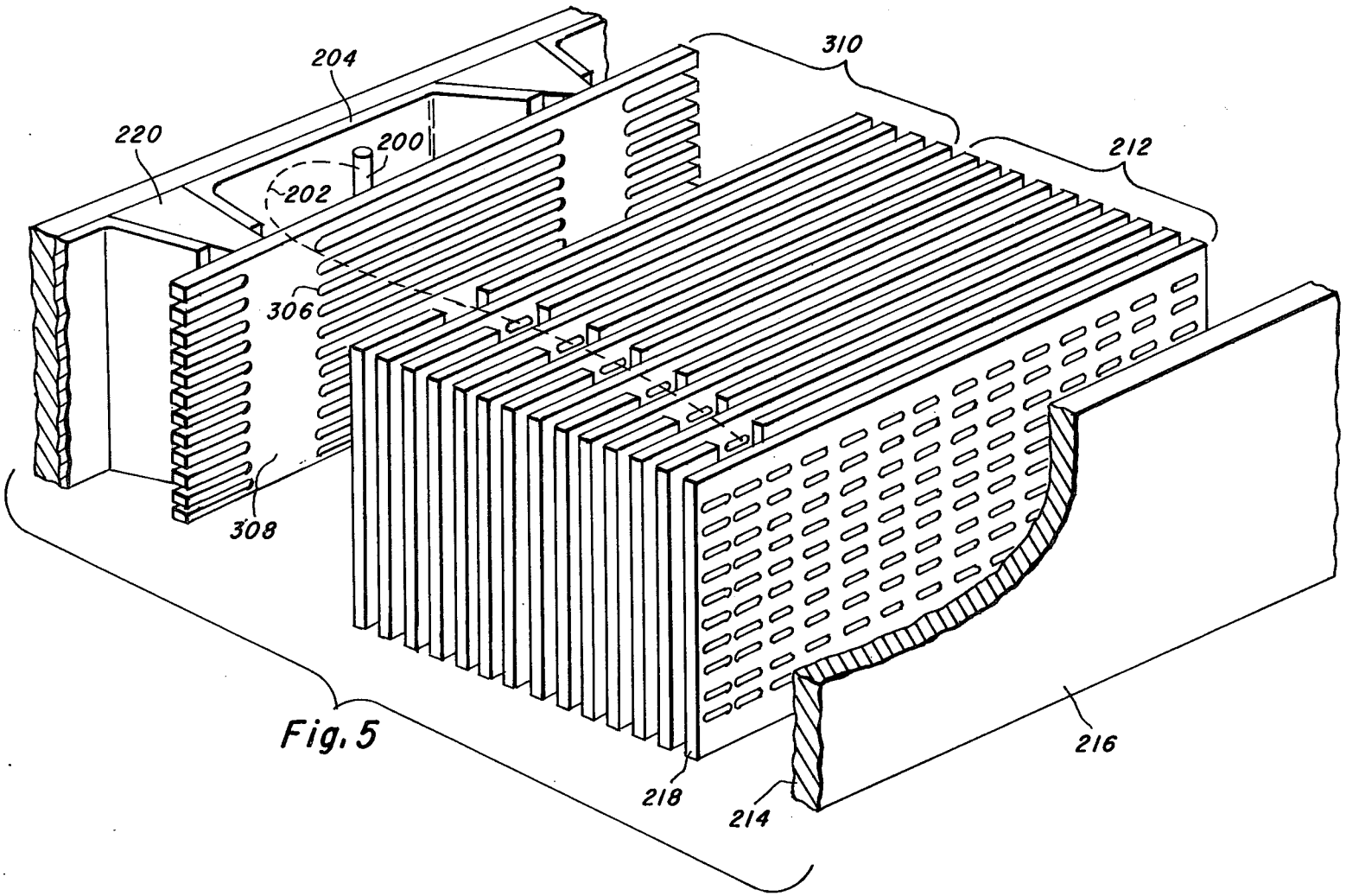

Referring now to FIG. 5, another embodiment using the slot concept is indicated. In this embodiment a super slot concept is employed whereby the slots 306 in the first control plate 308 of the stack are large enough to provide for the passage of 10 electron beams. This represents the total electron beams from one segment of the control stack emitted from one filament wire 200.

The super slot technique may be employed again in both the conventional non-supportive flat tube display or the rib supported flat tube display as indicated. FIG. 5 shows a plurality of first switching plates 310 and a second portion of accelerator plates 212. The operation of the flat tube display switching stack and accelerating stack is that as already described. In the fabrication of such a stack using the super slot technique all row switching plates and their associated buffer plates can be located in the cathode side of the stack; that is the first plates of the switching stack 310 and all column and output focusing plates can be located in the latter half of the switching stack.

One important feature of the super slot technique is that the super slot has such a wide acceptance angle for electrons that the filament wires can be placed much closer to the stack than conventional type flat tube displays. By moving the filament wire closer to the switching stack there is an increase in current density that results in improved brightness in the overall display.

It is not required that all the plates in the stack incorporate the slot or super slot concept. The use of slots allows for a larger acceptance angle for incoming electrons into the stack and makes the apertures easier to turn off. The plates of the stack may have a mixture of aperture geometries and arrangements. For example, the first input buffer plate and first column switching plate may incorporate the super slot. The row switching plate, modulating plate, and output buffer plate may use the slot geometry. The acceleration stack can be fabricated with either slots, super slots, or holes. Other combinations of holes, slots, and super slots are readily apparent to one skilled in the art.

Figure 6:
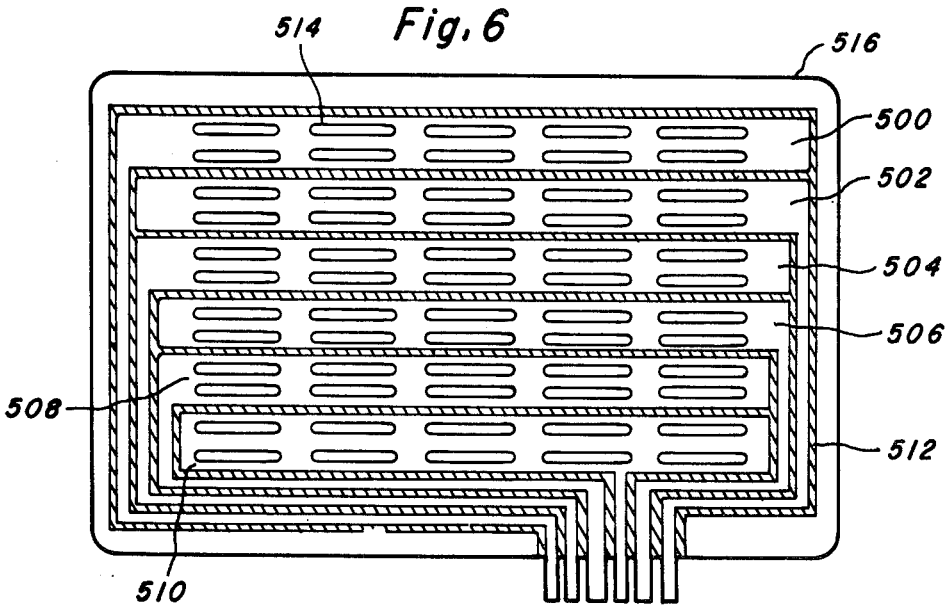
FIG. 6 is a front view showing the details of a switching plate that is contained within the control plate switching stack.

Referring now to FIG. 6 a row switching plate 516 using super slots is indicated. The switching plate has a matrix of super slot apertures defined therein. These apertures are arranged so as to constitute isolated separate conductive portions 500, 502, 504, 506, 508, and 510. These conductive portions are isolated from each other by means of isolation grooves 512 provided for during the manufacture of the assembly. These isolation grooves may define a selected pattern of apertures for selective activation as desired. Any number of holes may be grouped in any desired pattern. For example, columns or rows may be provided having any geometry pattern that would have utility in an electron beam scanning device.

While particular embodiments of this invention have been disclosed herein, it will be understood that various modifications may become apparent to those skilled in the art without departing from the spirit and scope of the invention which is defined by the appendix claims.

What is claimed is:

1. An electron beam scanning system comprising;

a gas evacuated sealed envelope;

an electron source mounted within said envelope;

a target member having a dot matrix thereon mounted within said envelope opposite said electron source;

a control stack comprising a plurality of control plates sandwiched between said electron source and said target member for controlling the flow of electrons therebetween, said control plates having a plurality of apertures formed therein, corresponding apertures of said control plates being aligned to form electron channels between said electron source and said target member;

said apertures arranged in a plurality of aperture matrixes such that the first plate of said control stack contains a matrix of apertures compressed to provide a flat portion free of aperture between adjacent sets of apertures matrixes, the remaining plates having aperture matrixes expanded such that the aperture matrix of the last plate of said control stack corresponds to said dot matrix; and means for supporting said control stack mounted between the back plate of said envelope and said first control plate, said supporting means in contact with said flat portion.

2. An electron beam scanning system as set forth in claim 1 wherein said supporting means further comprise elongated members mounted in a vertical position.

3. An electron beam scanning system as set forth in claim 1 further including means for applying increasing positive accelerating potentials to selected plates of said control stack to accelerate and guide electrons through said apertures to said target member.

4. An electron beam scanning system as set forth in claim 1 further including:

means for applying turn on potentials to selected apertures of said control stack to allow for the flow of electrons through said control plates to said target member; and means for providing a cut-off potential to the remaining apertures of said control plates to prevent the flow of electrons to said target member.

5. An electron beam scanning system comprising:

a gas evacuated sealed envelope;

an electron source mounted within said envelope;

a target member having a dot matrix pattern thereon mounted within said envelope opposite said electron source;

a control stack comprising plurality of control plates sandwiched between said electron source and said target member for controlling the flow of electrons therebetween, each of said control plates having a plurality of apertures formed therein, corresponding apertures of said control plates being pseudoaligned to form electron channels between said electron source and said target member;

said apertures arranged in a plurality of aperture matrixes such that the first plate of said control stack contains a matrix of apertures compressed to provide a flat portion free of apertures between the adjacent sets of aperture matrixes, the aperture matrix of the other plates in said control stack are expanded until the last plate of said control stack has an aperture matrix corresponding to said dot matrix pattern on said target member; and internal support structures mounted between the back plate of said envelope and said flat portion of said first plate of said control stack.

6. An electron beam scanning system as set forth in claim 5 further including means for applying increasing positive potentials to selected plates of said control stack to provide for the acceleration and guiding of electrons through the apertures of said control stack.

7. An electron beam scanning system comprising:

a gas evacuated sealed envelope;

an electron source mounted within said envelope;

a target member having a dot matrix pattern thereon mounted within said envelope opposite said electron source;

a control stack comprising a plurality of control plates sandwiched between said electron source and said target member for controlling the flow of electrons therebetween, each of said control plates having a plurality of aperture matrixes formed therein, corresponding apertures of said control plates being pseudo-aligned to form electron channels between said electron source and said target member;

said control stack comprising a first portion adjacent said electron source for switching said electrons wherein said apertures of at least the first plate of said first portion are compressed into aperture matrixes such that adjacent matrixes are separated by flat portions free of apertures;

said control stack having a second portion adjacent said target member for accelerating and guiding said electron beams from said first portion to said target member wherein said matrix of aperture of said second portion are expanded until the last plate of said second portion has an aperture matrix corresponding to said dot pattern on said target member, means for applying turn-on potentials to selected aligned apertures of said control plates in said first portion to allow for the flow of electrons therethrough;

means for applying cut-off potentials to selected apertures in said control plates of said first portion so as to prevent the flow of electrons therethrough;

means for applying increasing positive potentials to the control plates of said second portion to provide for the acceleration and guiding of electrons between said first portion and said target member; and internal support structures mounted between the back plate of said envelope and said flat portion of said first plate of said control stack.

* * * * *